US006367353B2

(12) United States Patent
Brucart Puig et al.

(10) Patent No.: US 6,367,353 B2
(45) **Date of Patent: *Apr. 9, 2002**

(54) MULTIPURPOSE SCREW

(76) Inventors: Ramon Brucart Puig; Marta Bonich Linares, both of Gustavo Becquer, 105, 08206 Sabadell (Barcelona) (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/252,603

(22) Filed: Feb. 17, 1999

(30) Foreign Application Priority Data

Feb. 17, 1998 (ES) ..... 9800323

(51) Int. Cl.[7] ..... B67B 7/04
(52) U.S. Cl. ..... 81/3.48; 81/3.36; 81/3.45

(58) Field of Search ..... 81/3.37, 3.09, 81/3.36, 3.47, 3.29, 3.39, 3.45, 3.55, 3.48

(56) References Cited

U.S. PATENT DOCUMENTS 6,101,900 A * 8/2000 Miguel ..... 81/3.09 X
6,116,116 A * 9/2000 Puig et al. ..... 81/3.09 X

* cited by examiner

*Primary Examiner*—D. S. Meislin
(74) *Attorney, Agent, or Firm*—Michael J. Striker

(57) ABSTRACT

A multipurpose corckscrew has a main body, a helical screw connected with the main body and introducible into a cork to be removed, an arm provided with an end tab and connected with the main body, a guide connecting the arm with the main body so that the arm is displaceable on the guide between a rear position and a forward position, means keeping the arm in the forward position, and elastic means pushing the arm toward the rear position.

4 Claims, 5 Drawing Sheets

MULTIPURPOSE SCREW

BACKGROUND OF THE INVENTION

The present invention relates to a multipurpose corckscrew which has a main body for holding and using it, a screw to be introduced into the cork and an arm with an end tab providing a support over the bottle neck during its uncorcking.

In the above mentioned corckscrews, both the screw and the arm are coupled to the main body with a folding capability with respect to said body.

For size and structural reasons, these corkscrews have generally a drawback in that only a partial extraction of the cork is achieved by actuating the main body and the extraction must be completed by pulling out the cork by hand. This poses a relevant problem to the users and especially to those not strong enough to carry out extraction by hand.

SUMMARY OF THE INVENTION

The multipurpose corkscrew which is the object of the present invention has been designed with great constructive simplicity in order to overcome the above mentioned drawback, allowing the main body to be used as a lever not only in the initial extraction phase (which is usual), but also in the final phase.

In accordance with the invention, the arm forming the corkscrew resting on the bottle neck is joined to the main body by means of a foldable guide to which it is fitted with longitudinal travel capability, so that it is possible to arrange the arm in a rear or forward position.

The possibility of arranging the arm in said two positions allows the arm to rest on the bottle neck in the initial phase as well as in the final phase of the extraction of the cork, using the corkscrew as a lever in both phases.

This feature provides an advantage as compared with conventional corkscrews since it is not necessary to apply an additional force to complete the extraction of the cork.

This corkscrew is provided with means allowing to keep the arm in the previously mentioned forward position and is also provided with elastic means which tend to displace the arm towards a rear position.

In accordance with the invention, the means intended to keep the arm in the forward position include a curved retainer which is rotatably mounted on the main body.

The elastic means tending to keep the arm in the rear position include a helical spring whose ends are fixed to lugs defined in the arm and in the corresponding guide.

When the retainer is not in operation its end is above the arm and may be used to extract crown cork bottle caps.

The arm is normally in the rear position due to the action of the spring and, in this position, it is used to carry out the initial extraction of the cork where it is desired that the arm rest on the bottle neck in the remainder of the extraction. It will be enough to move the arm towards the forward position and to fold the retainer which will actuate with its end against the oblique fin defined in the rear end of the arm, thus preventing the arm from receding due to the action of the spring.

BRIEF DESCRIPTION OF THE DRAWINGS

In order to complete the specification to provide a better understanding of the features of the invention, the present specification is provided with a set of drawings in which the following is shown only by way of example.

DESCRIPTION OF THE PREFERRED EMBODIMENT OF THE INVENTION

Figure 1:
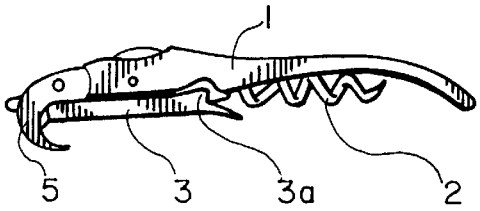
FIG. 1 shows an elevational view of the corkscrew in the closed position.

The multipurpose corkscrew which is the object of the present invention has a main body (1). A foldable helical screw (2) is intended to be introduced in the cork to be removed. An arm (3) is provided with an end tab (3*a*) which leans on the bottleneck during uncorking thereof.

The arm (3) is connected with the main body by means of a foldable guide (4) to which the arm is fitted with longitudinal travel capability. It is possible to arrange the arm (3) in a rear position (FIGS. 2) to partially extract the cork or in a forward position (FIG. 3) to completely extract the cork.

In order to allow the positioning of arm (3) in any of said positions, the corkscrew has a curved retainer (5) and a helical spring (6).

The retainer (5) which is rotatably mounted on the main body (1), may be placed in an inoperative position (FIGS. 1 and 2), in which case it acts as a means for removing crown cork type caps it can be placed also in an operative position (FIG. 3) acting against an oblique fin (3*b*) defined in the rear end of the arm (3) and keeping said arm in the forward position.

The helical spring (6) pulls the arm (3) towards the rear position and works with its ends on the lugs (3*c* and 4*a*) defined in the arm (3) and in the guide (4).

Figure 2:
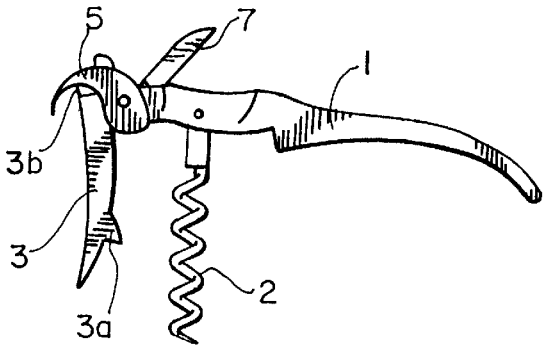
FIG. 2 shows an elevational view of the corkscrew in the open position with the arm in the position.
Figure 3:
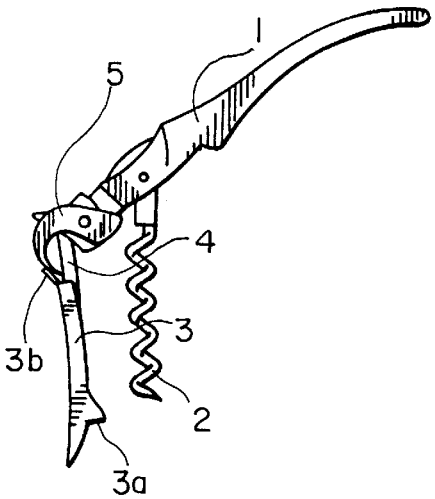
FIG. 3 shows an elevational view of the corkscrew in the open position with the arm in the forward position.
Figure 4:
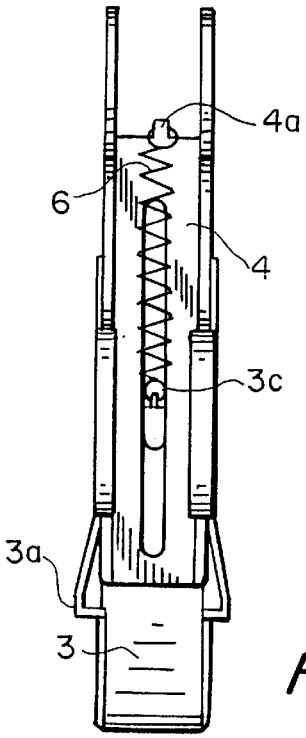
FIG. 4 shows an inboard-side view of the arm and of the guide which joins the arm to the main body as well as the elastic means tending to keep the arm in the rear position.

As may be seen in FIG. 2, the corkscrew also has a foldable blade (7) in order to allow the previous crown cork lifting of the bottles to be opened.

Figure 5:
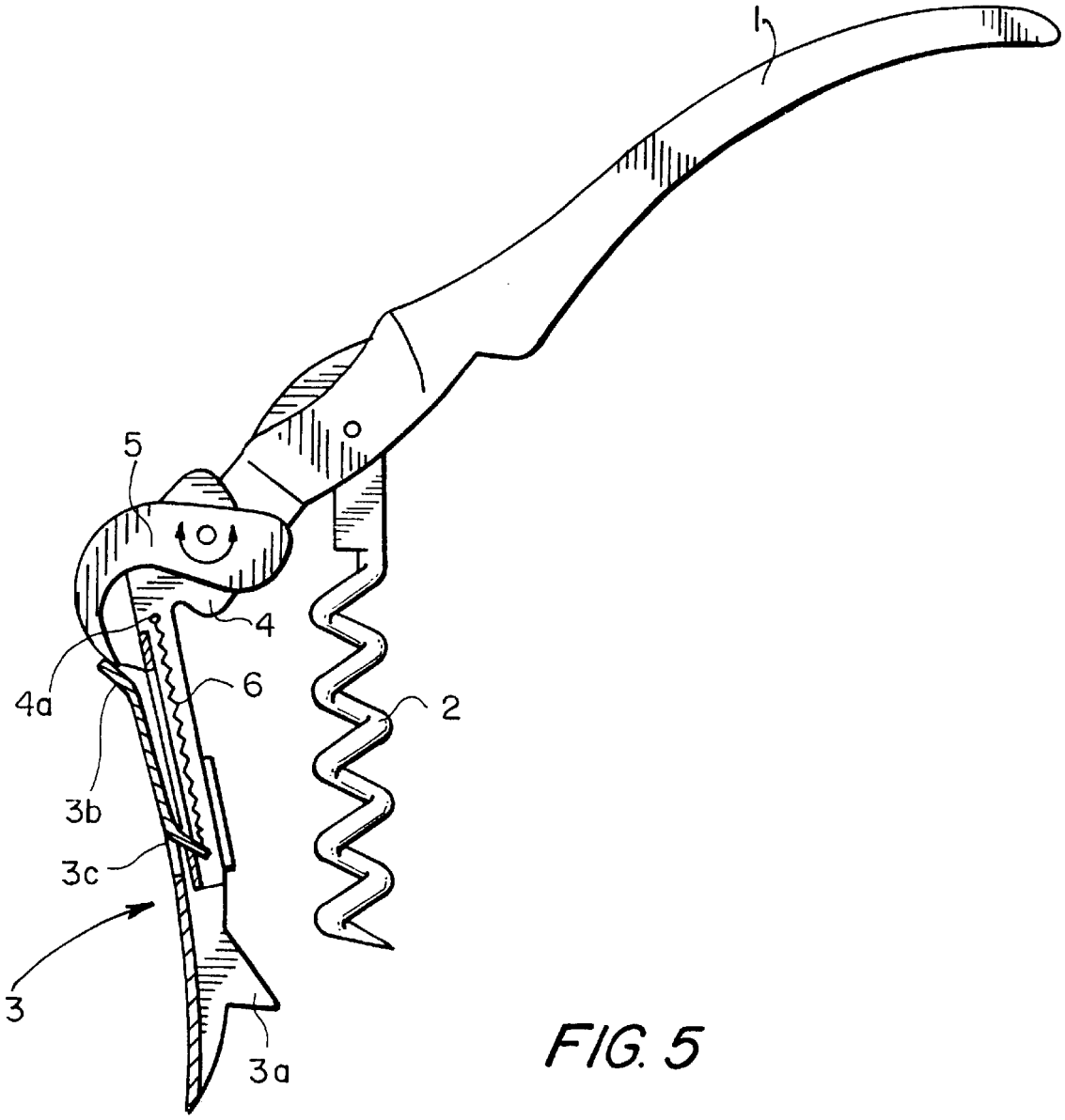
FIG. 5 is an enlarged view of the corkscrew substantially corresponding to the view of FIG. 3, but partially sectioned.
Figure 6:
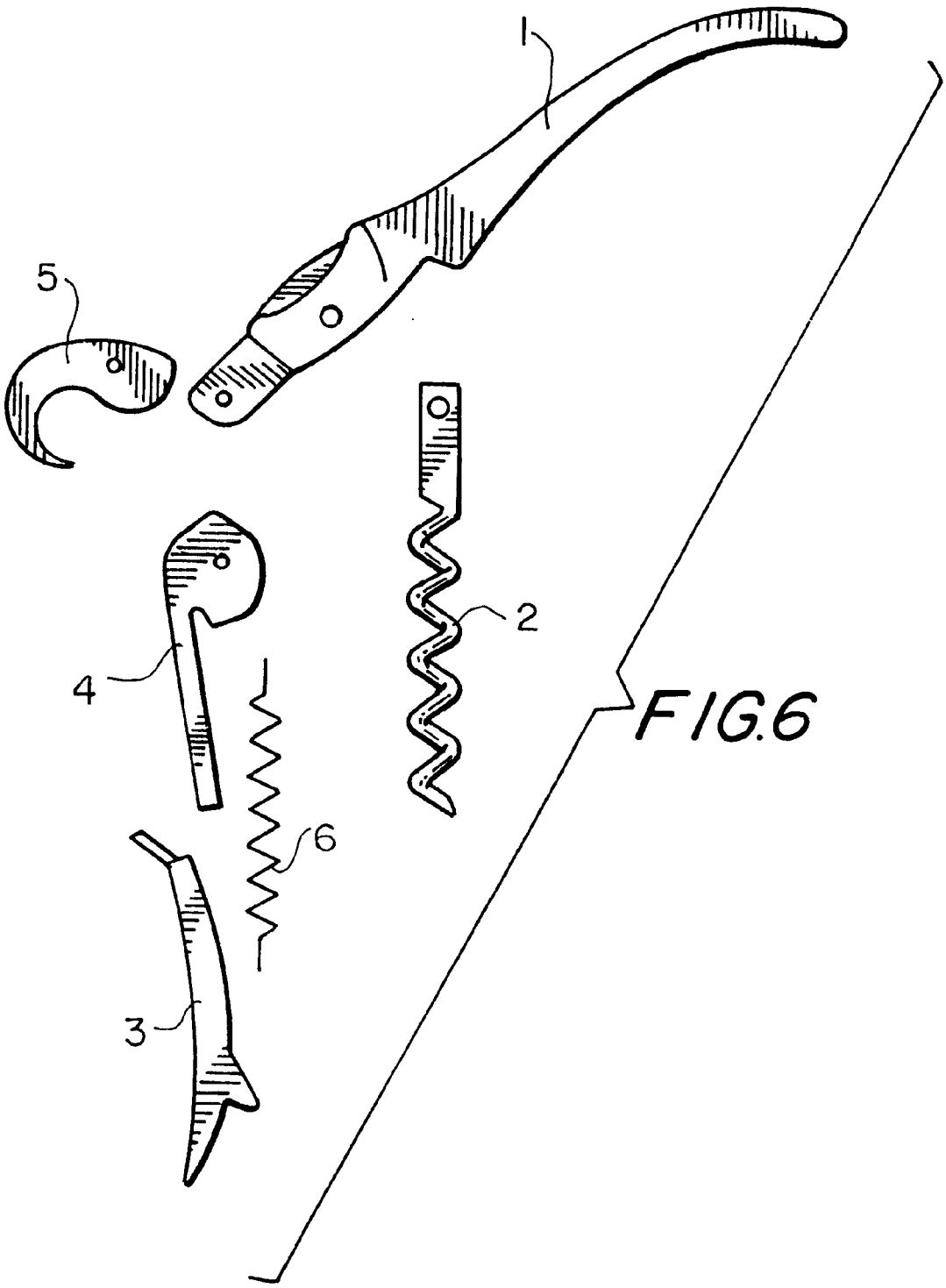
FIG. 6 is an exploded view showing corresponding parts of the corkscrew in accordance with the present invention.
Figure 7:
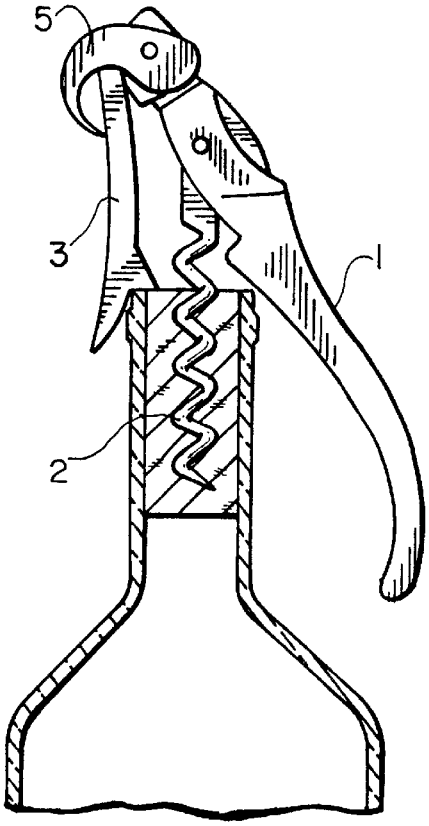
FIGS. 7–10 are views showing the corkscrew in accordance with the present invention, at different stages of operation.
Figure 8:
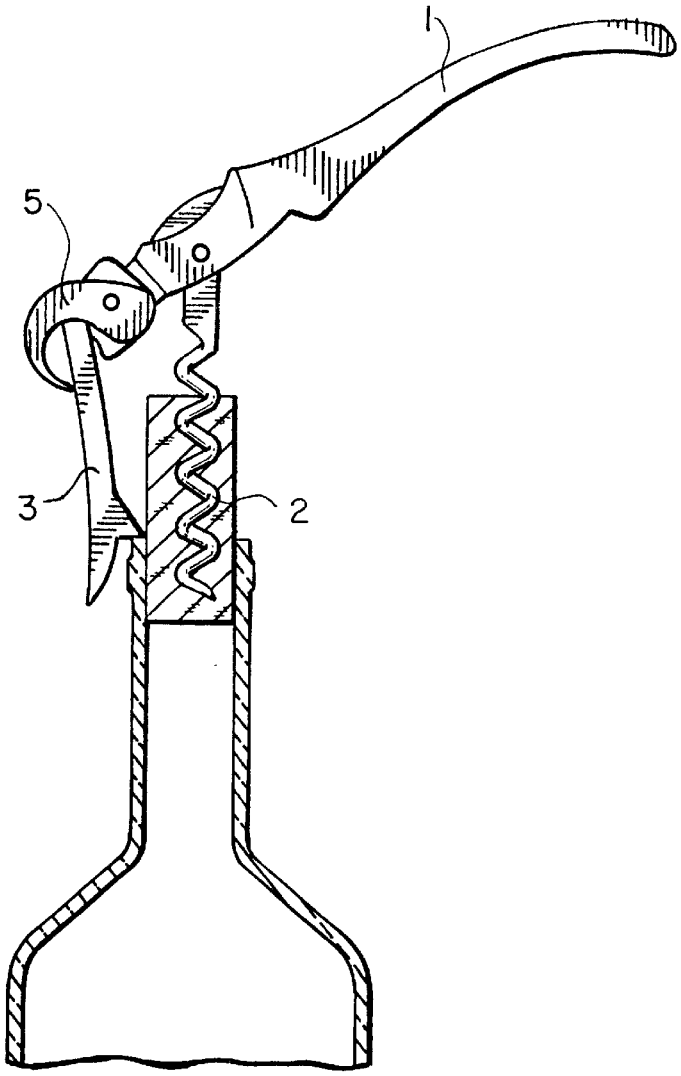
Figure 9:
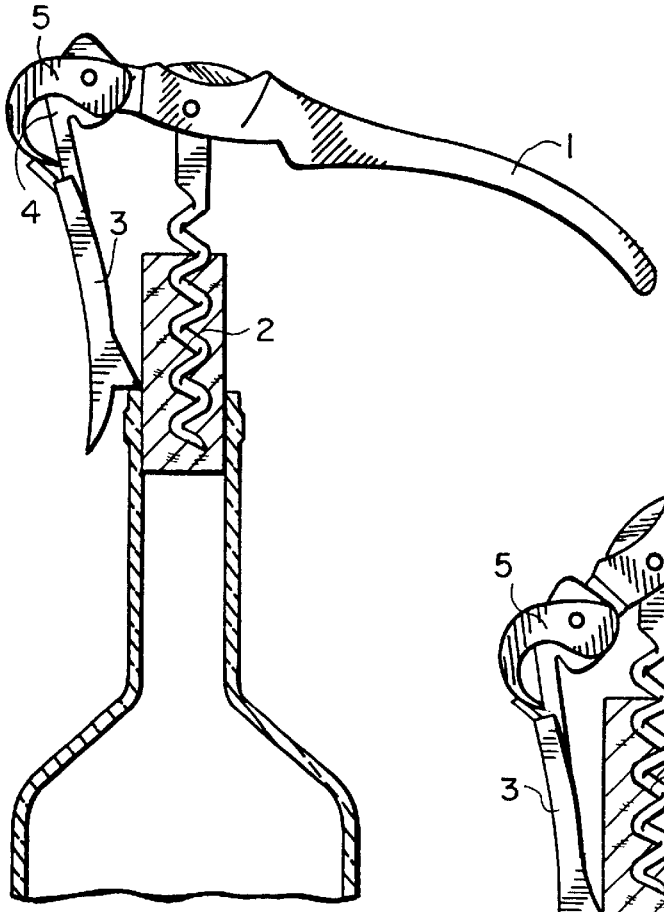
Figure 10:
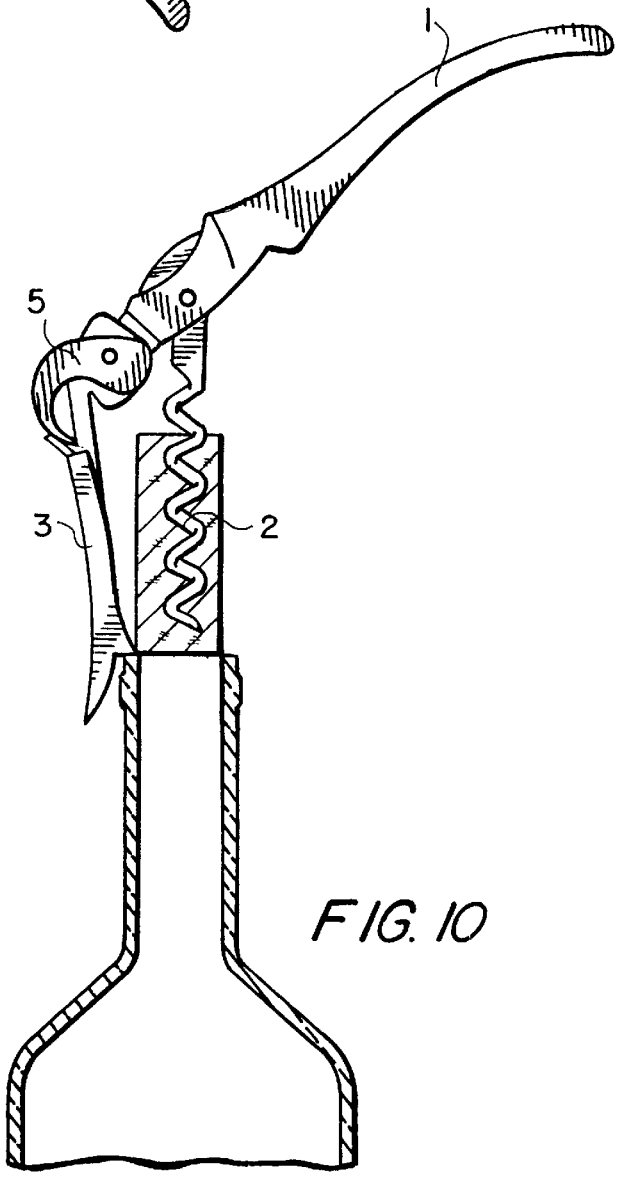

More details of the corkscrew can be seen on FIG. 5 which is an enlarged view, and partially sectioned, and also from FIG. 6 which shows individual parts of the corkscrew.

In order to carry out the removal of a bottle cap with the mentioned means, it is firstly necessary to arrange the arm (3) in the rear position, to make the tab lean on the bottle neck and to level with the body (1) until a part of the cork is removed. Then, the arm (3) will move on the guide (4) overcoming the resistance of the spring (6) and will be blocked in the forward position by means of the retainer (5), so that the total removal of the cork will be carried out once the tab (3*a*) rests on the bottleneck and the main body (1) is actuated as a lever, due to the greater distance between the tab (3*a*) and the body (1).

This is essentially illustrated in FIGS. 7–10.

It is not considered it necessary to extend this specification for any persons skilled in the art to understand the scope of the invention and the advantages derived from it.

The terms in which this specification has been drafted should always be interpreted in the widest sense and not limited in any way.

The materials, shape, size and arrangement of the components may be changed provided this does not suppose an alteration of the basic features of the invention which are claimed below.

What is claimed is:

1. multipurpose corkscrew, comprising a main body, a helical screw connected with said main body and introducible into a cork to be removed; an arm provided with an end tab and connected with said main body; a guide connecting said arm with said main body so that said arm is displaceable on said guide between a rear position and a forward position; means keeping said arm in said forward position; and elastic means pushing said arm toward said rear position, said means for keeping said arm in said forward position including a curved retainer which is rotatably connected with said main body, said retainer being formed so as to act as a crown cork lifting component when it is in an inoperative position.

2. A multipurpose corckscrew as defined in claim 1, wherein said arm has an end provided with an oblique fin for acting against said retainer when said arm is in said forward position.

3. A multipurpose corckscrew as defined in claim 1, wherein said elastic means include a helical spring having two opposite ends connected to said arm and to said guide.

4. A multipurpose corckscrew as defined in claim 3, wherein said arm and said guide are provided with a lug, said helical spring having ends fixed to said lugs.

* * * * *